US005201297A

United States Patent [19]

Eblen et al.

[11] Patent Number: 5,201,297

[45] Date of Patent: Apr. 13, 1993

[54] METHOD AND APPARATUS FOR CONTROLLING A HIGH-PRESSURE FUEL PUMPING TIME IN A FUEL INJECTION PUMP

[75] Inventors: Ewald Eblen, Stuttgart; Anton Karle, Leonberg; Helmut Laufer, Gerlingen; Max Straubel, Stuttgart, all of Fed. Rep. of Germany

[73] Assignee: Robert Bosch GmbH, Stuttgart, Fed. Rep. of Germany

[21] Appl. No.: 238,433

[22] Filed: Aug. 31, 1988

[30] Foreign Application Priority Data

Sep. 4, 1987 [DE] Fed. Rep. of Germany ..... 3729636

[51] Int. Cl.[5] ..... F02M 37/04

[52] U.S. Cl. ..... 123/502; 123/506; 123/449; 417/490

[58] Field of Search ..... 123/502, 449, 179 L, 123/506, 458; 417/490

[56] References Cited

U.S. PATENT DOCUMENTS

| | | | |
|---|---|---|---|
| 3,709,639 | 1/1973 | Suda et al. | 417/493 |
| 3,965,875 | 6/1976 | Perr | 123/496 |
| 4,037,573 | 7/1977 | Swift | 123/139 |
| 4,132,508 | 1/1979 | Mowbray | 417/462 |
| 4,276,000 | 6/1981 | Warwicker . | |
| 4,395,987 | 8/1983 | Kobayashi | 123/506 |
| 4,432,327 | 2/1984 | Salzgeber | 123/502 |
| 4,475,519 | 10/1984 | Eheim | 123/502 |
| 4,476,837 | 10/1984 | Salzgeber | 123/502 |
| 4,526,154 | 7/1985 | Didomenico | 123/502 |
| 4,546,749 | 10/1985 | Igashira | 123/506 |
| 4,557,240 | 12/1985 | Sakuranaka | 123/179 L |
| 4,619,239 | 10/1986 | Wallenfang et al. . | |
| 4,652,221 | 3/1987 | Kato | 123/496 |

FOREIGN PATENT DOCUMENTS

| | | | |
|---|---|---|---|
| 3010312 | 10/1981 | Fed. Rep. of Germany . | |
| 3310872 | 10/1983 | Fed. Rep. of Germany . | |
| 3532719 | 3/1987 | Fed. Rep. of Germany . | |
| 0051139 | 3/1984 | Japan | 123/506 |
| 2119030 | 11/1983 | United Kingdom . | |

*Primary Examiner*—Carl S. Miller

*Attorney, Agent, or Firm*—Edwin E. Greigg; Ronald E. Greigg

[57] ABSTRACT

It is possible in a simple manner, especially in distributor injection pumps, to attain quiet combustion in the idling range of a Diesel engine, without modifying the basic construction of the fuel injection pump by shifting the injection pumping to the last portion of the stroke of the cam driving the pump piston of the fuel injection pump for idling, by means of an injection onset adjusting device, in combination with a determination of injection duration via the closing phase of an electrically controlled valve that relieves the pump work chamber.

5 Claims, 6 Drawing Sheets

METHOD AND APPARATUS FOR CONTROLLING A HIGH-PRESSURE FUEL PUMPING TIME IN A FUEL INJECTION PUMP

BACKGROUND OF THE INVENTION

The invention is directed to an improved method and apparatus for reducing the noise associated with a diesel engine at idling speeds. In such a method, known from German Offenlegungsschrift 33 10 872, the adjustment of the cam drive varies the fuel pumping rate in a controlled manner. The method uses a radial piston injection pump, in which in cooperation with the electrically controlled valve, even the beginning of the cam lobe curve can be effectively exploited for injection. A shift is made from a low fuel injection rate, corresponding to the relatively low initial rise of the cam lobe curve, to a high fuel injection rate, corresponding to the middle range of the cam lobe curve. This is done in order to adapt both the injection onset and the injection rate to the needs of the engine, and in particular to vary them during engine operation.

Low-noise combustion of the small quantities of fuel that are injected for low-load or idling operation is a particular problem in Diesel engines. A great many proposals have been made, which to this end strive to prolong the duration of injection, which is associated with a simultaneous reduction in the injection rate. To lessen the noise, as little fuel as possible should abruptly ignite at the instant of ignition. If injection is performed in these special operating ranges at a low fuel injection rate, then only some of the fuel ignites abruptly; the rest of the as yet uninjected fuel is delivered continuously thereafter. Such provisions for prolonging the injection duration can be put into practice by revising how either the injection valve or the pump is constructed. These provisions typically entail high construction costs, especially if the reduction of the fuel injection rate is supposed to take place by diverting partial fuel quantities, bypassing the fuel quantity pumped at high pressure.

OBJECT AND SUMMARY OF THE INVENTION

It is a principal object of the method according to the invention to provide an advantage over the above-mentioned prior art in that since the portion of the cam lobe curve up to top dead center is especially chosen for the pump piston drive at low load, and because of the flat curve course then prevailing, a desired low fuel injection rate for the sake of lessening the noise during engine idling is attainable. This object is attained via a resultant shift of the injection onset to "late", accomplished initially by triggering the electric valve, being compensated for by shifting the injection onset toward "early" via an adjustment of the cam drive. As the engine load increases from the low-load range, a shift to "late" then takes place at the cam drive, and this shift is superimposed on the usual rpm-dependent shift of the injection onset to "early". This compensation makes it possible to meet all the demands upon the engine for operation in the special idling or low-load range. For normal operation, the pump, which otherwise is embodied in the usual manner, is operated in a known manner. With the injection adjusting device set back to normal operation, the injection onset can then be controlled either by the injection adjusting device or by the triggering of the electrically controlled valve.

It is another object of the invention and an advantageous feature thereof that the basic adjustment in the second operating range can be attained by a simple pre-adjustment, so that the expense for control is kept quite low.

It is yet another object of the invention to provide means by which a conventional injection adjusting device of the kind mass-produced in great quantity for mechanically controlled fuel injection pumps can be utilized to perform the method. Thus the fuel injection pump according to the invention can be realized using the system of modular construction.

Still another object of the invention is to provide means by which a conventional injection adjuster can be modified in simple fashion, without hindering its shift toward "early" that is to be performed as a function of rpm.

In a further object of the invention, the injection adjustment control can be globally varied, and moreover, still further parameters besides those of rpm, load and idling operation can be taken into consideration; cold-starting conditions are an example.

In yet another object of the invention other means are provided that offer possibilities for accurate adjustment, using injection adjusting devices known per se.

Still a further object of the invention advantageously offers the opportunity for leaving the rpm-dependent injection onset adjustment characteristics of the injection adjusting device unaffected, simply by shifting the entire injection onset adjusting device for operation in the idling range.

The invention will be better understood and further objects and advantages thereof will become more apparent from the ensuing detailed description of preferred embodiments, taken in conjunction with the drawing.

DESCRIPTION OF THE PREFERRED EMBODIMENTS

Figure 1:
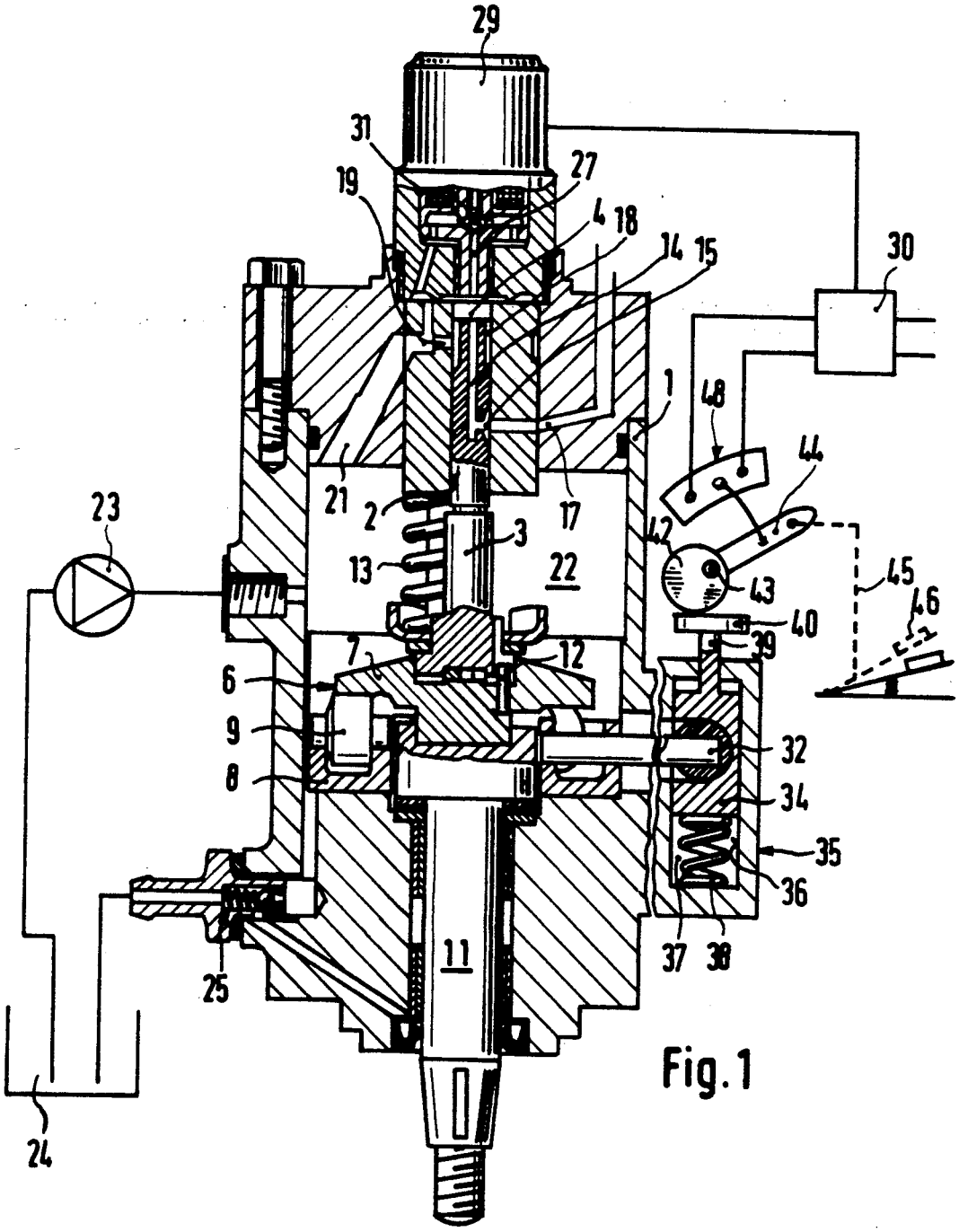
FIG. 1 shows a distributor injection pump for performing the method according to the invention, in a first exemplary embodiment having injection adjustment coupled to the gas pedal of the engine.

In a housing 1 of a fuel injection pump, a pump piston 3 supported in a pump cylinder 2 encloses a pump work chamber 4 at the face end of this pump cylinder 2. The pump piston is set into reciprocating and simultaneously rotary motion by a cam drive 6, which comprises a cam plate 7 that rolls off on a rotatable roller ring 8 with rollers 9. To transmit the rotary motion, the cam plate 7 is coupled to a drive shaft 11 guided through the housing and at the other end is coupled via a pin 12 to the pump piston, which is retained by two springs 13 on the cam plate 7, which in turn is retained on the rollers 9. The pump piston, as it rotates, simultaneously acts as a distributor, by directing fuel that it has positively displaced from the work chamber 4 to one of a plurality of fuel injection lines 17, via a longitudinal bore 14, which is adjoined by a distributor opening 15 opening toward the pump piston jacket face. The fuel injection lines 17 lead away from the pump cylinder in a radial plane and are distributed about the pump cylinder in accordance with the number of pumping strokes of the pump piston per revolution, or with the number of fuel injection locations to be supplied. The injection lines lead to injection nozzles, not shown in detail, on the engine.

The pump piston is provided with fill grooves 18, which are disposed on the pump piston in the form of longitudinal grooves beginning at its end toward the pump work chamber and which, during the intake stroke extend into the pump work chamber and come to communicate in alternation with a fill opening 19 discharging into the pump cylinder. The fill opening 19 communicates via a suction conduit 21 with the interior of the pump housing, where a fuel-filled suction chamber 22 is provided. This chamber is supplied with fuel from a fuel supply container 24 by a fuel feed pump 23, and is kept below a controlled pressure with the aid of a pressure valve 25 that controls the outflow from the suction chamber to the fuel supply chamber, or to the intake side of the feed pump 30.

Also communicating with the pump work chamber 4 is a relief conduit 27, which also leads to the suction chamber 22 but contains an electrically controlled valve 29, which is controlled by a control unit 30. The control is effected such that by means of a valve closing member 31 of the electrically controlled valve 29, the relief conduit 27 is closed whenever fuel, brought up to high pressure, is supposed to attain injection. In this way, the onset of fuel injection during the pump piston pumping stroke can be defined with the closure of the electrically controlled valve, and the end of fuel injection and hence the quantity of fuel to be injected can be defined with the opening of the valve. The injection phase is thus determined in a manner known per se by varying the control times of the magnetic valve; these times can be varied within a wide range, as long as the cam provided for driving the pump piston permits this variation by allowing a suitable stroke length. In distributor injection pumps of this type, intended for supplying a low number of injection locations, such as a three-or four-cylinder distributor injection pump, a relatively long cam flank is available on the cams provided on the cam plate 7. However, if the number of injection locations to be supplied per revolution increases, then the available cam height decreases, because for the sake of strength as well as dynamic behavior the cam flanks cannot be embodied arbitrarily steeply. This also reduces the number of options for accomplishing the injection onset shift toward "early" that is necessary in dynamic engine behavior.

Besides the above option for varying the injection onset, a second option for this purpose is also available in the exemplary embodiment provided. To this end, an actuating arm 32 radially engages the roller ring 8, being coupled at its other end to an adjusting piston 34 of an injection adjusting device 35. The adjusting piston is supported in a guide cylinder 36, where with one face end it encloses a spring chamber 37, in which a restoring spring 38 supported between the adjusting piston and the guide cylinder is disposed. This chamber is relieved of pressure. On the other side of the adjusting piston, a tang 39 protrudes from the face end, extending axially to the outside through the end wall of the guide cylinder 36, where it has a stop plate 40 against which a cam 42 comes to rest. This cam 42 is pivotable about a shaft 43 offset from the center by a lever 44, which via a coupling device 45 is coupled to a gas pedal 46, with which a driver of the vehicle driven with the engine supplied by the fuel injection pump expresses the desired torque, that is, the attainable rpm or vehicle speed. Also coupled to the lever 44 is a travel transducer 48, the output signal of which is supplied to the control unit 30 and which is advantageously embodied as a potentiometer coupled to the gas pedal which changes the output signal as the gas pedal is adjusted by the operator.

Figure 2:
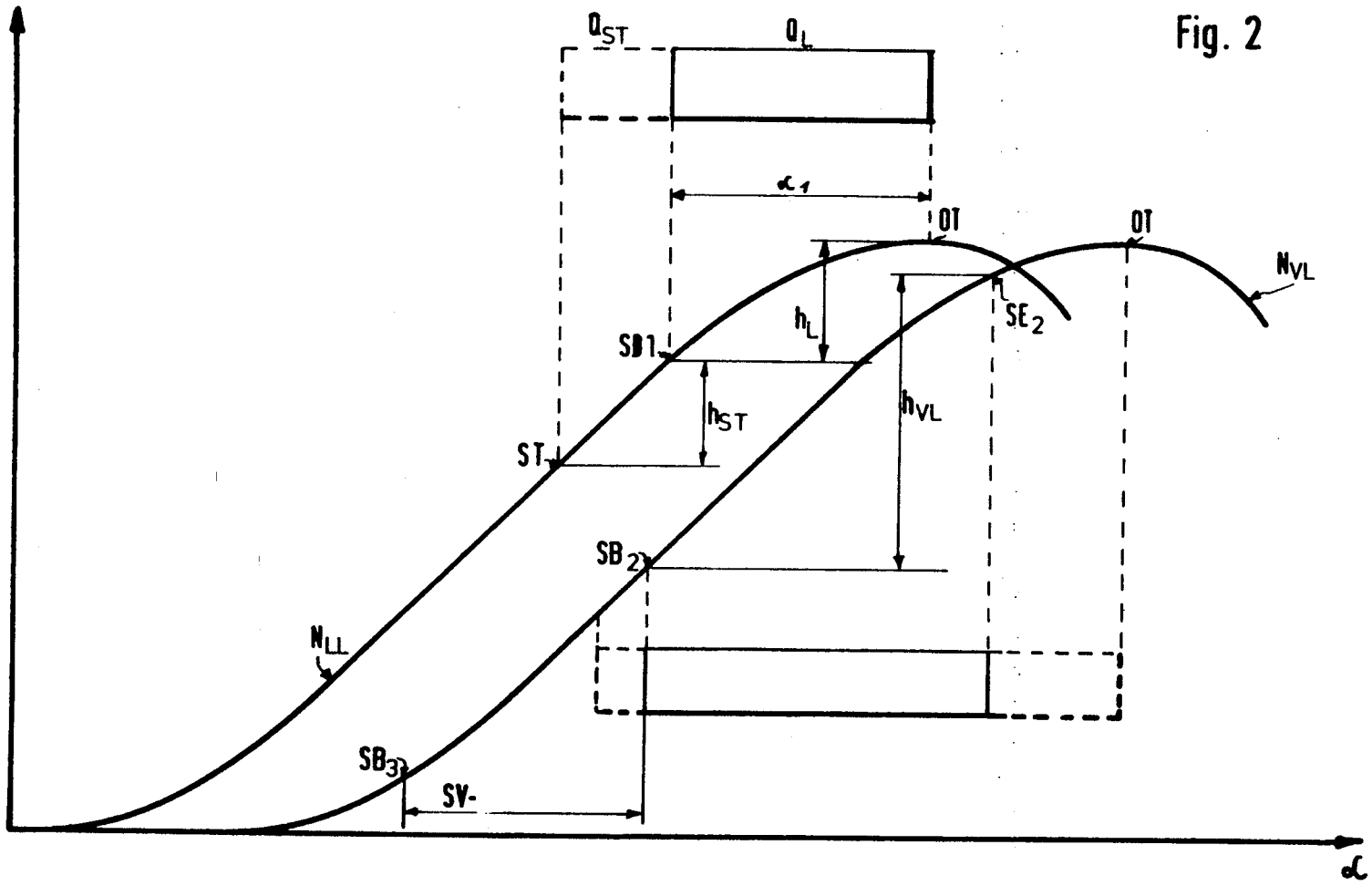
FIG. 2 is a diagram plotting the control times for the first exemplary embodiment.

With the injection adjusting device, the rotational position of the roller ring 8 can be varied, thus varying the rotational angle of the drive shaft 11, cam plate 7 or pump piston 3 at which a cam of the cam plate 7 begins to run up against one of the rollers. For uniform distribution of the load, a plurality of rollers 9 are provided, which cooperate with a similar number of cam lobes. The adjustment of the roller ring is effected as a function of the load, in accordance with the actuation of the gas pedal 46. The device is designed such that at the idling position of the gas pedal, the onset of the pumping stroke of the pump piston occurs at an early rotational angle, while with increasing load it is shifted to a later rotational angle. This relationship is expressed in the diagram of FIG. 2. There, two cam lobe curves are plotted over the rotational angle $\alpha$; the left-hand curve defines an operating state of the engine or of the fuel injection pump in which only a small quantity of fuel attains injection. This corresponds to idling. This adjustment enables the earliest-possible injection onset. The control unit 30 now triggers the electrically controlled valve 29 in accordance with the invention, such that the pump piston pumps the fuel to be pumped until it attains its top dead center position. The valve correspondingly closes the valve 29 at top dead center (TO in the drawing), or shortly thereafter. The quantity of fuel that attains injection in this operating range is now fed under control in such a way that it is shifted to before top dead center. At a pumping stroke $h_L$ necessary for this purpose, the electrically controlled valve must be closed at a point SB1 (standing for injection onset 1). To inject this idling quantity in accordance with $h_L$, the fuel injection pump requires a rotational angle of $\alpha_1$, that is, from $SB_1$ to TO. If the same quantity were to attain injection over a lesser cam stroke, then, as can readily be seen from the diagram, a substantially smaller rotational angle would be necessary. The advantage of the triggering selected here during idling operation is that the fuel injection quantities attaining injection do so over a larger rotational angle, which in the final analysis then means a very low fuel injection rate.

If the engine is to be started without actuation of the gas pedal, then the idling quantity must be increased by the excess starting quantity $Q_ST$, or the stroke $h_st$. In that case, the electrically controlled valve 29 closes at an even earlier instant, ST. This further shift toward "early" is very much in tune with what is needed, because when an engine is still cold, a longer injection delay must be expected. Shifts toward "early" are typically done when starting a cold engine, so that the introduced fuel will attain ignition in timely fashion prior to top dead center.

Upon an increase in load from idling, more fuel has to be injected. Here, a shift toward "early", which would take place if the cam lobe curve on the left prevailed unchanged, would not be desirable. With the shift in injection onset toward "late" according to the invention, occurring with increasing load upon gas pedal actuation, the left-hand curve shifts to the right. In the diagram, the full-load position of the cam lobe curve is shown as the curve on the right. To the extent of the shift of the cam lobe curve to "late", the location of the injection phase can be shifted downward on the cam, in the steeper portion of the cam. In the right-hand curve $N_{VL}$, the full-load stroke $h_{VL}$ is shown as an example. The end of injection $SE_2$ is located prior to top dead center OT. The injection onset $SB_2$ is located in the middle range of the cam flank, and relatively late. This corresponds to the location of injection at full load and low rpm. If the rpm increases, then the injection onset can be shifted to the bottom of the cam lobe curve. The injection onset $SB_3$ plotted there indicates the injection onset for the full-load fuel injection quantity $h_{VL}$ at high rpm. The injection onset for full-load operation thus varies in the range between $SB_2$ and $SB_3$. If an excess starting quantity is to be furnished, which is to be fed in with the pedal position defined by full load, then here the starting quantity through the range from $SB_2$ to OT can be appended, in accordance with the low rpm. Up to the earliest possible injection onset, a quantity of fuel also can be shifted to before time $SB_2$.

With this embodiment, in which the injection onset adjusting device is rigidly coupled to the gas pedal and the control unit 30 is provided with both feedback and detection of all the parameters necessary for the injection quantity and injection onset, a low fuel injection rate can be made available for idling operation without great additional mechanical expense. The cam length, or the cam stroke of the drive cam, can be fully exploited for the actual injection process, without losing the effective pumping stroke used for the pumping of the bypass fuel quantity.

Figure 3:
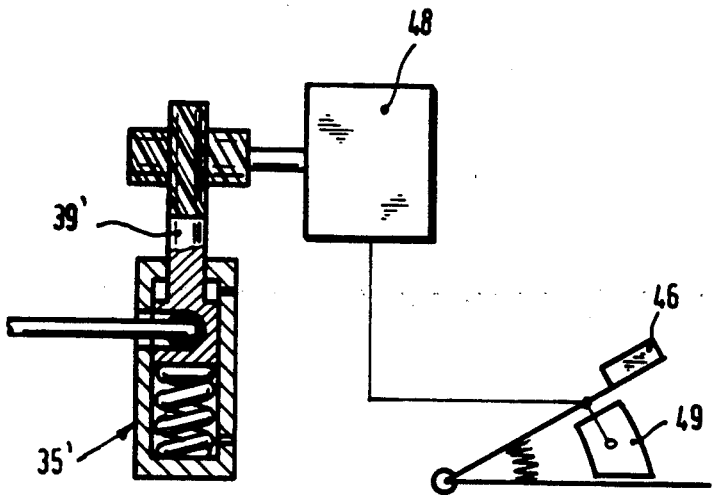
FIG. 3 is a first variant of the first exemplary embodiment.

A variant for coupling the injection adjusting device is represented by the injection adjusting device 35' of FIG. 3. Here the tang 39' is actuated not by a cam via a connecting rod from the gas pedal 46, but by a control motor 48, which transmits the motion of the gas pedal 46 to the tang 39' via a travel transducer 49 which detects this motion and directs an output signal to the motor. A gear motor or a worm drive may be provided.

Figure 4:
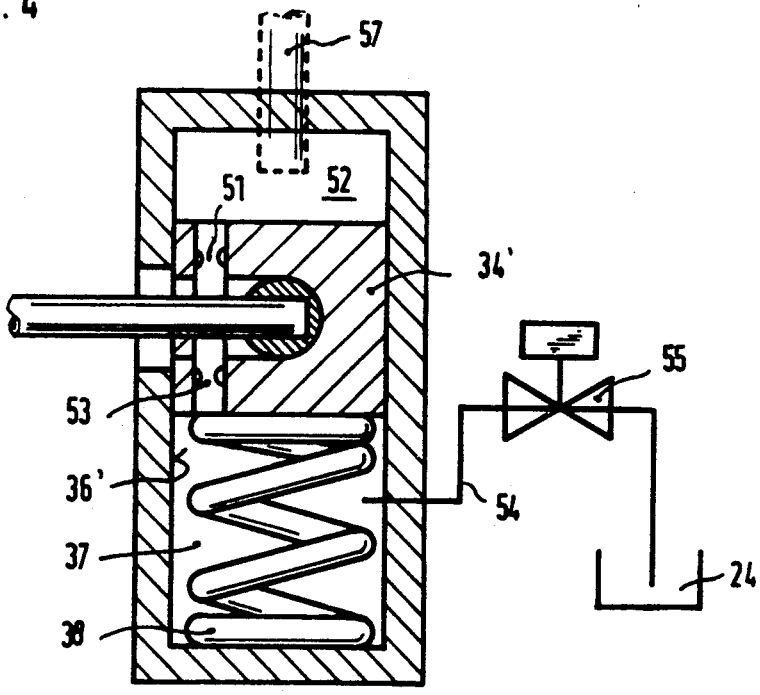
FIG. 4 is a second variant of the injection adjustment of the first exemplary embodiment.

A variant of the above embodiments is shown in FIG. 4. There, the pressure in the suction chamber 22 is controlled in accordance with rpm and carried via a throttle opening 51 in the adjusting piston 34' into a work chamber 52, which chamber is defined by the face end of the adjusting piston 34' and the guide cylinder 36', remote from the spring chamber 37. With increasing rpm or increasing pressure in the suction chamber 22, the adjusting piston 34' is then displaced counter to the force of the restoring spring 38, which corresponds to a shift toward "early". Additionally, the spring chamber 37 communicates with the suction chamber 22, likewise via a throttle 53. The relief line 54 leading away from the spring chamber 37 to the fuel supply container 24 includes a magnetic valve 55, which is triggered by the control unit 30. With this valve, which may be triggered in clocked or in analog fashion, the pressure in the spring chamber 37 can be increased, so that a relative shift toward "late" is superimposed on the above-described shift toward "early". The advantageous result is a shift toward "late" by means of an angular shift in the cam lobe curve, and the stroke of the cams can be optimally exploited for the fuel injection. In addition, the injection phase in the idling range can be shifted to the uppermost end of the cam lobe curve, as was described above. All that is necessary is to trigger a magnetic valve. This kind of pressure control, with the aid of a magnetic valve, can also be used, with suitable adaptation, for controlling the pressure in the work chamber 52, instead of in the spring chamber. Alternatively, however, instead of adding a magnetic valve 55 and the throttle 53, the spring chamber 37 can be relieved entirely, as in the exemplary embodiment of FIGS. 1 and 3. For the shift to "early" in the idling range, an adjusting member 57 can be introduced into the work chamber 52 at the face end, through the guide cylinder 36', as shown in dashed lines in FIG. 4, and there can shift the adjusting piston 34' toward "early", counter to the force of the spring 38, for idling operation. This shift is rescinded as the load increases, and independently of it, a shift toward "early" takes place because of the rpm-dependent pressure operative in the work chamber 52. The drive provided for the tangs 39 and 39' in the embodiment of FIGS. 1 and 3 may be used to drive the adjusting member here.

Figure 5:
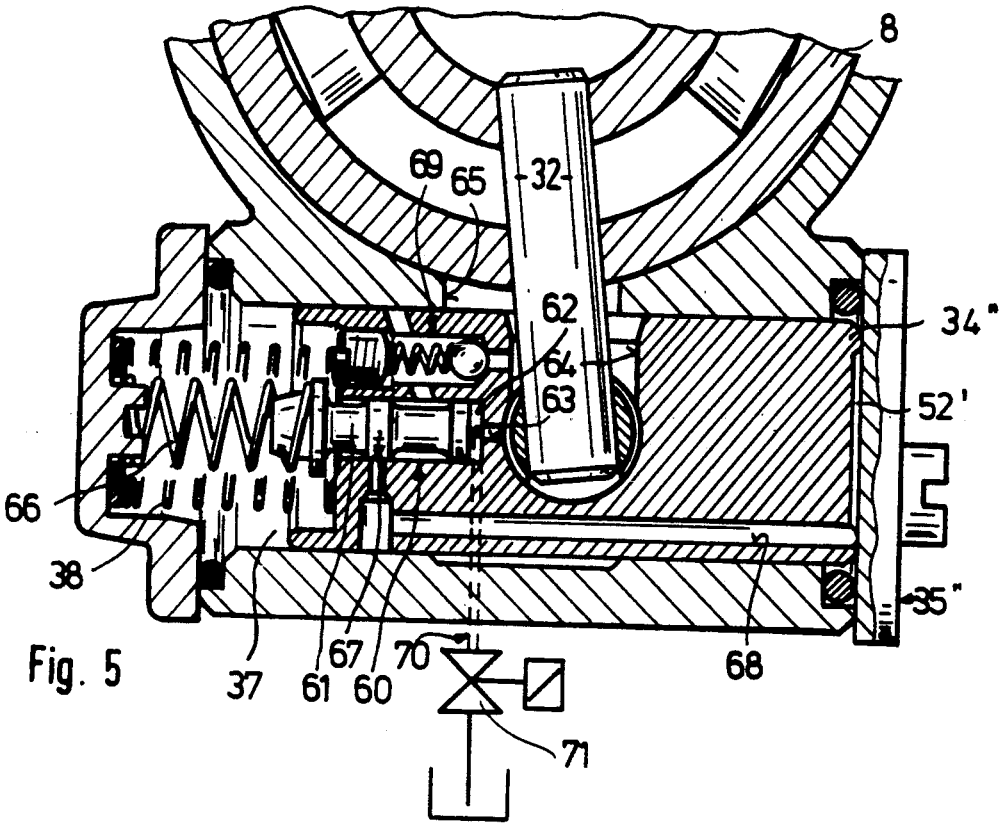
FIG. 5 shows a fourth exemplary embodiment having an injection adjuster, provided with a control piston or servo piston, with control pressure varied by means of a magnetic valve.

In a fourth embodiment, shown in FIG. 5, the injection adjustment can also be accomplished with a follower piston arrangement (such as that known from German Offenlegungsschrift 35 32 719). In the adjusting piston 34'', a coaxial guide cylinder 60 opening toward the spring chamber 37 is provided, in which a control piston 61 is displaceable and which with its inner end face encloses a work chamber 62 that communicates with the pump suction chamber 22 via a throttle 63, a radial recess 64, via which the actuating arm 32 protrudes into the adjusting piston 34'' for coupling, and via a connecting opening 65 through which the actuating arm passes through the wall of the pump housing to engage the roller ring 8. On the other end, the control piston is acted upon by a control spring 66, which is supported on the housing of the injection adjusting device 35''. Two annular grooves on the control piston define a middle collar 67, which depending upon its position connects a pressure conduit 68, extending radially from the guide cylinder 60 and leading toward the work chamber 52' of the adjusting piston 34'', either with the pressure-relieved spring chamber via an annular groove, or with the recess 64 or suction chamber 22 via the other annular groove and a check valve 69. Since the pressure in the work chamber 62 varies as a function of rpm, the control piston 61 is disposed increasingly far counter to the control spring 66 as the rpm increases. If such a displacement takes place out of the position of equilibrium shown in FIG. 5, then via the conduit 68 fuel is introduced into the work chamber 52', until such time as the pressure conduit 68 is once again closed by the collar 67, because of the resultant shift of the adjusting piston 34'' counter to its restoring spring 38. Conversely, if the pressure in the work chamber 52' drops, then the control piston shifts to the right under the influence of the control spring 66; the work chamber 52' is relieved in favor of the spring chamber 37, with the result that the pressure chamber closes in cooperation with the collar 67, via the adjusting piston 34'' which is shifting once again. In this sense, a follower piston arrangement is thus achieved, which is initially controlled by the rpm-dependent pressure in the work chamber 62. This pressure can now be modified by the decoupling throttle 63, in combination with a relief conduit 70 of the work chamber 62, analogously to, the embodiment of FIG. 4. A magnetic valve 71 that is correspondingly triggered by the device 60 is disposed in the relief conduit 70. Once again, an rpm-dependent shift toward "early" is attained, and at the same time a shift toward later injection from an earlier injection is attainable as the load increases.

Figure 6:
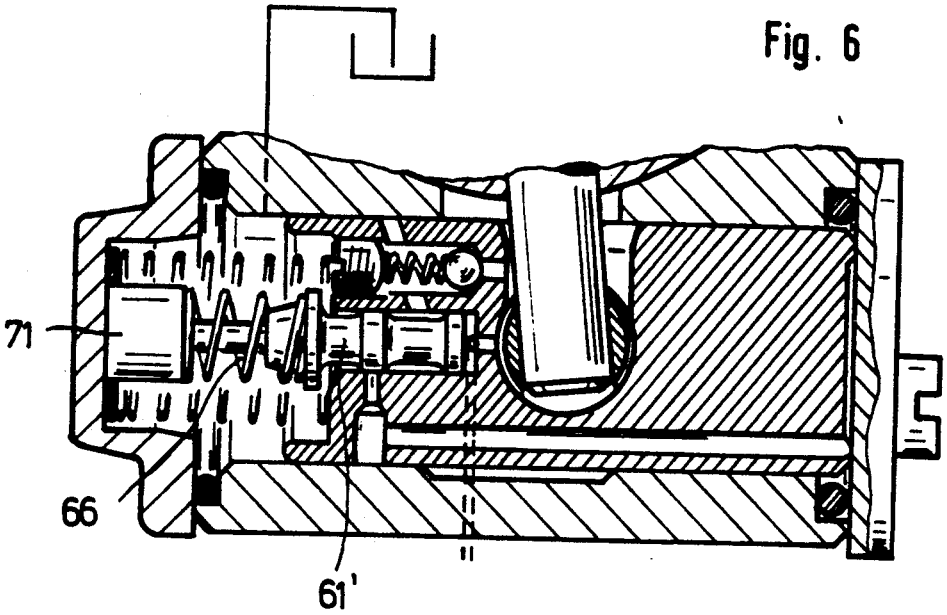
FIG. 6 shows a variant of the version of FIG. 5, having a control slide actuated by a control motor or stepping motor.

FIG. 6 shows an alternative embodiment. A control slide 61' is provided, which can be loaded with an additional force brought to bear by an electric final control element, control motor or stepping motor 71 from the direction of the control spring 66. The force ratio that acts upon the control slide 61' is thus varied, and a superposition of an rpm-dependent shift toward "early" and a load-dependent shift toward "late" is attainable. Instead of being loaded by control pressure, the control slide 61' can finally also be rigidly coupled to an electric adjusting device; in that case, the control spring 66 is dispensed with, as is the connection of the work chamber 62 with the suction chamber 22. The work chamber 62 is then relieved. Upon actuation of the control piston, the adjusting piston is moved in followup fashion in a known manner.

Figure 7:
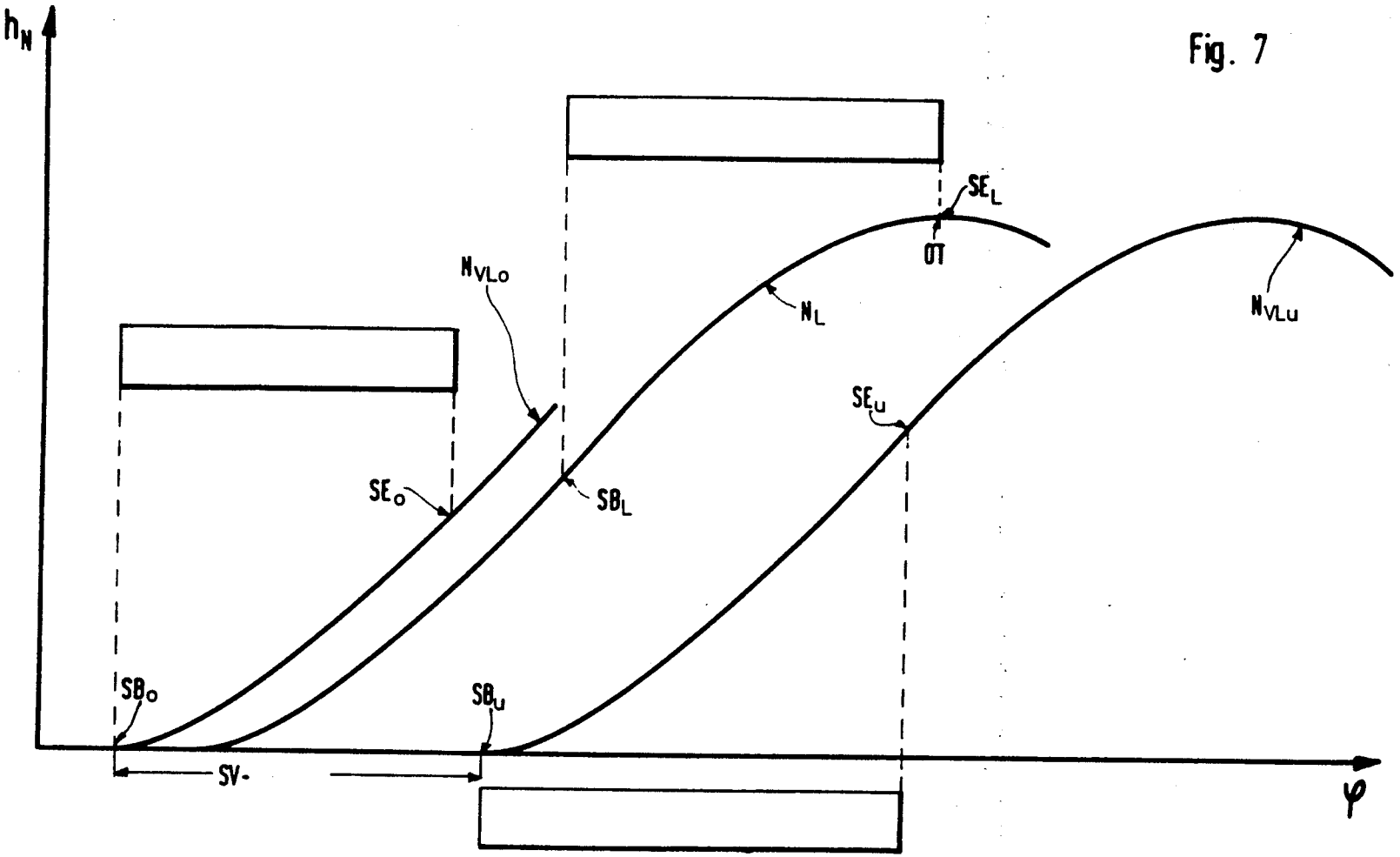
FIG. 7 is a diagram showing the mode of operation of the exemplary embodiments of FIG. 5 and FIG. 6.

The fuel injection pump equipped with the above embodiments makes it possible to supply a large number of cylinders with fuel per revolution of the pump piston. In particular, this arrangement makes possible optimal utilization of the cam stroke, yet an injection up to top dead center of the cam can still be achieved for idling. With the rpm-dependent shift toward "late" by shifting of the cam, no cam stroke needs to be made available for varying the injection onset. Thus, the injection can already take place at the beginning of the cam lobe, and can be shifted as far as the steep range of the cam lobe curve. In FIG. 7, two cam lobe curves for full-load operation are shown: the curve on the right, $N_{VLu}$, and the curve all the way to the left, $N_{VLo}$. The curve on the right stands for the cam position for a lower rpm range, that is, corresponding to a late injection onset, and the curve all the way to the left stands for a high rpm range, that is, an early injection onset. A cam position for the idling range is also shown: the curve $N_L$. While in full-load operation, as noted above, the injection onset $SB_u$ or $SB_o$ is located at the beginning of the cam lobe curve, and the end of injection $SE_u$ or $SE_o$ is located in the middle region of the cam lobe. In the case of the cam curve $N_L$, analogously to FIG. 2, the end of injection $SE_L$ is located at the point OT, and the injection onset $SB_L$ is located in the upper portion of the cam lobe curve. At the same time, the cam curve $N_L$ is shifted to "early", so that analogously to FIG. 2 the early injection onset that is required can be obtained, and to compensate for the shift toward "late", that is, toward top dead center. From this position of the cam curve in idling, if there is a load increase and a corresponding rpm increase the location of the cam lobe curve required for injection is set by the control unit 30 with respect to the drive rotational angle $\alpha$. To this end, a feedback of the actual injection onset by known transducers can also be performed.

Figure 8:
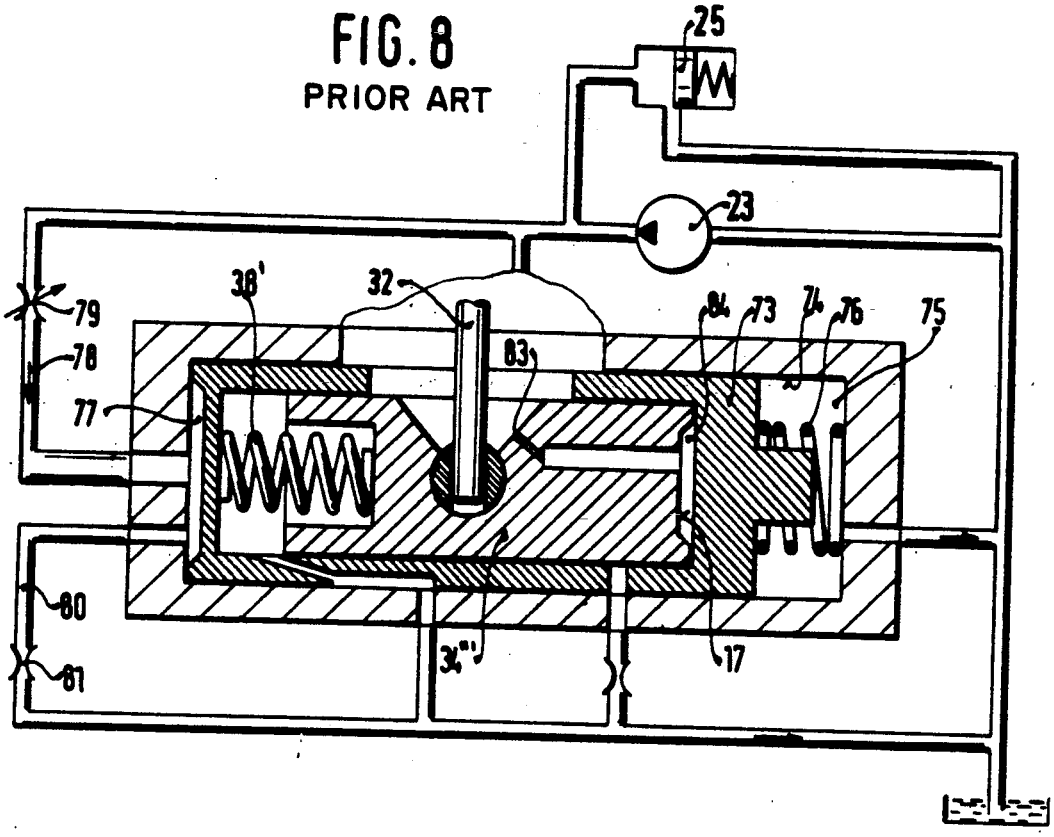
FIG. 8 PRIOR ART
FIG. 8 illustrates a prior art control device in which an injection adjusting piston of the injection adjusting device is supported in a support piston, the support piston being adjustable by means of a controlled control pressure.

FIG. 8 is a special, known injection adjuster of the kind disclosed in German Offenlegungsschrift 30 10 312. A support piston 73 is provided here, which is displaceable in a cylinder 74 and thus on one end encloses a spring chamber 75, in which a restoring spring 76 is supported between the support piston 73 and the cylinder 74. On its other face end, the support piston encloses a work chamber 77, which communicates, via a pressure line 78 and a valve 79 included in the pressure line, with a pressure source. At the same time, the work chamber communicates with a relief chamber via a relief line 80, in which a throttle 81 may optionally be disposed. With the aid of the valve 79, a control pressure is established in the work chamber 77; this pressure is shifted more or less far counter to the force of the restoring spring 76, depending upon the position of the support piston 73. The adjusting piston 34''' is displaceably disposed in the support piston, and as in the exemplary embodiment of FIG. 4 is acted upon on one end by a restoring spring 38' supported on the support piston, while on the other end it is loaded by a hydraulic control pressure, which is introduced via a throttle 83 from the suction chamber 22 into the work chamber 84 enclosed on the face end between the adjusting piston 34''' and the support piston 73. The adjusting piston 34''' is thus displaced rpm-dependently in a known manner counter to the force of the restoring spring 38', in the course of which it shifts relative to the support piston 73. In a known manner, a shift toward "early" is thus brought about, which once again is transmitted to the roller ring via the actuating arm 32. A shift of the support piston 73 itself can now be superimposed on this shift to "early". This shift of the support piston may be such, in accordance with the above specification, that with increasing load, it shifts toward "late", beginning at an initial "early" position. This embodiment has the advantage of retaining not only the original adjusting characteristic of the rpm-dependent shift but the entire operating range of the adjusting piston 34''' as well.

Figure 9:
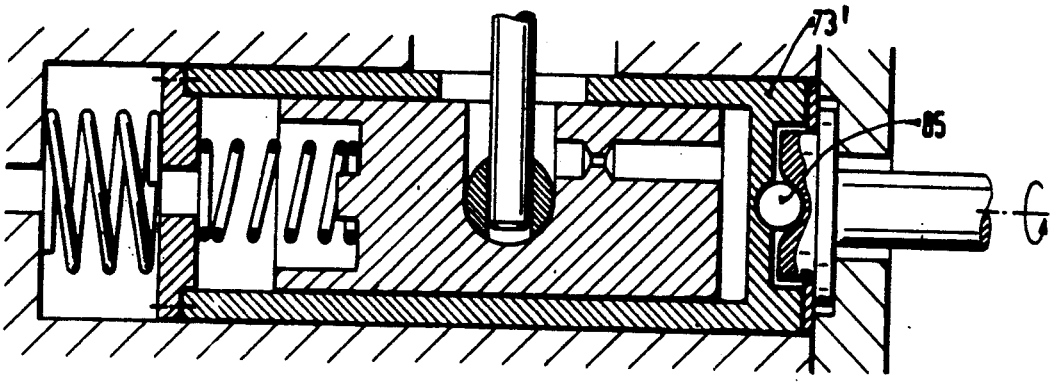
FIG. 9 PRIOR ART
FIG. 9 shows a prior art variant of the exemplary embodiment of FIG. 8, in which the support piston is adjusted mechanically by an adjusting member.

A prior art modification of the exemplary embodiment of FIG. 8 is provided in the embodiment of FIG. 9, in which the shift of the support piston 73' is accomplished mechanically rather than hydraulically. To this end, a cam 85 is provided on the end of the support piston remote from the spring chamber 78, and upon actuation, this cam 85 shifts the support piston 78. The cam may then be actuated by an electric control motor, for example, controlled by the control unit 30. Once again, the position of the support body 73' can be fed back as in the above embodiment of FIG. 8, instead of or in addition to detecting the injection onset directly.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A method for controlling the time of high-pressure fuel pumping in a fuel injection pump during the pumping strokes of a pump piston, actuatable by an adjustable cam drive, of the fuel injection pump, by means of determining the time of the closing state of a valve, which is disposed in a relief line leading away from the pump work chamber of the fuel injection pump and is controlled electrically by an electric control unit, wherein by the selection of the time of the closing state in combination with a controlled shift of the cam drive relative to the drive shaft of the fuel injection pump, various regions of variable steepness of the cam driving the pump piston in its pumping stroke become operative, and the injection duration and injection onset are controlled by the electric control unit in accordance with the needs of the engine, comprising shifting the time of high-pressure fuel pumping in a first engine operating range from partial load to full load in the range from the beginning to the middle region of the cam lobe curve of the cam drive, by means of controlling said valve and controlling said cam drive by independent operating parameters and in a second engine operating range, corresponding to low load, shifting the end of the time of the closing stage of the electrically controlled valve constantly to top dead center or to after top dead center of the cam driving the pump piston and shifting of the cam drive in a "early" position, and form there toward "late" with an increasing fuel injection quantity.

2. A method as defined by claim 1, in which in the second operating range, a basic setting of the cam drive, and hence of the injection onset, that is settable as a function of the load takes place, and additionally a shift of the cam drive toward "early" with increasing rpm takes place, superimposed on the basic setting.

3. A fuel injection pump for low noise diesel engine operation which comprises a pump housing, a pump piston (3) which is driven in reciprocation by a cam drive (6), in a pump cylinder (2), a pump work chamber (4) formed by said pump cylinder and an end of said pump piston which during an intake stroke of said pump piston is made to communicate with a low-pressure source of fuel in a fuel chamber (22) via a suction conduit (21) and during its pumping stroke made to communicate with an injection line (17) which injects fuel to a fuel injection valve and with said fuel chamber (22) via a relief conduit (27) controlled by an electrically controlled valve (29), wherein a time of a closing state of said electrically controlled valve (29) determines a time of high-pressure fuel pumping to said fuel injection valve by said pump piston, an injection adjusting device (35), having an adjusting piston (34) by means of which said injection adjusting device adjusts a rotational angle at which a pumping stroke of the pump piston begins relative to a rotational angle of a drive shaft (11) of the fuel injection pump, said adjusting piston is operatively coupled with a shift member (46) of the engine, and with increasing load said adjusting piston is adjustable as a function of said shift member position from a cam onset shifted to "early" at low load to a cam onset shifted to "late" at high load.

4. A fuel injection pump as defined by claim 3, which includes a travel transducer that detects an instantaneous position of said adjusting piston, said travel transducer has an output which is connected to an electric control unit (30), by means of which the control times of the electrically controlled valve (29) and in particular its closing time is formed relative to the parameters that are definitive for the injection onset.

5. A fuel injection pump as defined by claim 4, characterized in that at engine starting with the shift member (46) in the idling position, an excess starting quantity is furnished by shifting the closing instant of the electrically controlled valve (29) toward "early" by signals from said travel transducer.

* * * * *